US012364294B2

(12) United States Patent
Rosati et al.

(10) Patent No.: US 12,364,294 B2
(45) Date of Patent: Jul. 22, 2025

(54) PROCTECTIVE HOOD FOR MEDICAL USE

(71) Applicant: THI TOTAL HEALTHCARE INNOVATION GMBH, Feistritz im Rosental (AT)

(72) Inventors: Giorgio Rosati, Feistritz im Rosental (AT); Paul Gruber, Feistritz im Rosental (AT)

(73) Assignee: THI TOTAL HEALTHCARE INNOVATION GMBH, Feistritz im Rosental (AT)

( * ) Notice: Subject to any disclaimer, the term of this patent is extended or adjusted under 35 U.S.C. 154(b) by 748 days.

(21) Appl. No.: 17/754,613

(22) PCT Filed: Nov. 9, 2020

(86) PCT No.: PCT/IB2020/060507
§ 371 (c)(1),
(2) Date: Apr. 7, 2022

(87) PCT Pub. No.: WO2021/099881
PCT Pub. Date: May 27, 2021

(65) Prior Publication Data

US 2022/0361602 A1 Nov. 17, 2022

(30) Foreign Application Priority Data

Nov. 19, 2019 (IT) ..... 102019000021555

(51) Int. Cl.
*A41D 13/11* (2006.01)
*A41D 13/12* (2006.01)

(52) U.S. Cl.
CPC ..... *A41D 13/1153* (2013.01); *A41D 13/1218* (2013.01); *A41D 2400/44* (2013.01)

(58) Field of Classification Search
CPC .. A62B 17/04; A62B 17/006; A41D 13/1209; A41D 13/1218; A41D 13/1236;
(Continued)

(56) References Cited

U.S. PATENT DOCUMENTS 3,955,570 A 5/1976 Hutter, III
4,901,716 A * 2/1990 Stackhouse ..... A42C 5/04 128/201.28

(Continued)

FOREIGN PATENT DOCUMENTS

KR 20140062972 A * 11/2012

OTHER PUBLICATIONS

Machine Translation of KR-20140062972-A. Accessed from PE2E Search tool on Mar. 2025. (Year: 2012).*

(Continued)

*Primary Examiner* — Kendra D Carter
*Assistant Examiner* — Jaeick Jang
(74) *Attorney, Agent, or Firm* — LUCAS & MERCANTI, LLP

(57) ABSTRACT

A protective hood for surgical use, apt to be worn, in sterile form, by an operator over an instrumented helmet, is provided. The hood includes a front vision lens and an enveloping main body fixed to the vision lens, configured to cover wholly the operator's head and neck and an upper part of the chest.

The enveloping main body has a front portion and a rear portion connected and made integral by means of two opposite side portions, wherein the rear portion has a pair of lateral strings arranged on opposite sides with respect to a sagittal plane of the operator and which extend, in use, laterally outside, which strings are grasped by the operator during wearing in order to ease unwinding the hood.

18 Claims, 7 Drawing Sheets

(58) Field of Classification Search
CPC ..... A41D 13/1245; A41D 13/129; A41D 2300/33; A42B 1/046; A42B 1/048; A42B 1/012
See application file for complete search history.

(56) References Cited

U.S. PATENT DOCUMENTS

| | | | | |
|---|---|---|---|---|
| 5,253,642 | A | 10/1993 | Stackhouse et al. | |
| 5,867,825 | A | 2/1999 | Scheerer | |
| 2014/0116429 | A1* | 5/2014 | Patil | A62B 7/10 128/201.12 |
| 2016/0165973 | A1* | 6/2016 | Yazdi | A41D 27/28 2/457 |
| 2020/0060375 | A1* | 2/2020 | Jascomb | A62B 18/003 |
| 2021/0093024 | A1* | 4/2021 | Christensen | A41D 13/1218 |

OTHER PUBLICATIONS

International Search Report and Written Opinion for Corresponding International Application No. PCT/IB2020/060507, Feb. 8, 2021, 13 pages.

* cited by examiner

PROCTECTIVE HOOD FOR MEDICAL USE

CROSS-REFERENCE TO RELATED APPLICATIONS

This application is a 371 of PCT/IB2020/060507, filed Nov. 9, 2020, which claims the benefit of Italian Patent Application No. 102019000021555, filed Nov. 19, 2019.

TECHNICAL FIELD OF THE INVENTION

The present invention relates to a hood, typically a disposable hood, of the type used by a healthcare operator, in particular a surgeon, in association to a protection helmet.

BACKGROUND

As it is known, the current surgical procedures provide that the surgeon wears a protective, generally instrumented, helmet thereover a, often disposable, hood is worn. The latter covers the helmet, and then the subject's head, as well as the neck and portion of the chest. Over the hood, or better the thoracic portion thereof, then a gown is worn, generally of disposable type too.

The above-mentioned dressing apparatus aims at guaranteeing conditions of external complete sterility of the operating surgeon and it results, due to its nature, quite complex, above all in relation to the wearing modes. In fact, the hood is provided folded under sterility conditions and it includes a lens to be positioned at an appropriate dedicated opening. While unwinding the hood rear portion bringing the latter to cover the subject's nape and shoulders there is the risk that the external portion of the hood itself is touched, by the surgeon himself/herself or by the operator helping him/her, under not sterile conditions. For example, such portion can come in contact with the surgeon's arms or with other portions of the body not protected by the sterile gloves. This, actually, nullifies the harnessing of the surgeon and, however, in an often not perceived and then not remedied way.

Moreover, when the surgeon gets dressed autonomously, the wearing of the hood results to be extremely uncomfortable, in particular in the phase requiring the reversal of a portion thereof to cover the nape and the back. Such procedure involves unnatural motions of the arms which then cause discomfort to the surgeon himself/herself indeed in a phase preceding the operation in which he/she should keep rested and concentrated.

The same drawbacks occur even in relation to other applications of the hood of the above-mentioned type, not necessarily medical applications, and other operators, not necessarily healthcare operators, for example in the so-called "clean rooms" of the research and experimental laboratories.

SUMMARY OF THE INVENTION

The technical problem placed and solved by the present invention then is mainly to provide a protective hood allowing to solve the drawbacks mentioned above with reference to the known art.

Such problem is solved by a hood according to claim 1.

Preferred features of the present invention are set forth by the depending claims.

In the context of the present description, the terms "sagittal", "front", "anterior", "lateral", "posterior", "upper", "lower" and derivatives are assigned to hood elements or positions thereof and referred to the worn configuration of the hood itself, even in association to the anatomical definitions of the body of the operator who dresses it.

In general terms, the hood of the invention is of the type suitable to cover wholly, or almost wholly, the operator's head, neck and an upper part of the chest.

The hood of the invention provides a pair of strings (or "cheststraps"), attached to the rear portion of the hood covering the head, the neck and the upper part of the chest. Such strings can be grasped by the surgeon with sterile gloves and they allow him/her to wear autonomously and easily the hood, by pulling it in position without the risk of contaminating the external portion thereof.

Said strings are configured so as to allow to maintain—during wearing—a sufficient distance between the arms of the subject and the main body of the hood so as not to determine interference of the arms with the outside of the hood itself. Therefore, the risk of contamination between external portion of the hood, which is sterile, and subject's body, which is not sterile, reduces drastically.

Advantageously, the same two strings can be knotted, or however connected to one another, at the user's chest at the end of the wearing procedure. In this way, they keep in position the front, rear and side portions of the main body of the hood, in particular during the subsequent phase of wearing the gown.

Therefore, when the surgeon, or generally the operator, is wholly harnessed and ready for the work which he/she has to accomplish, the strings remain inside the harnessing, that is under the gown.

In other words, the strings are devised and positioned as help for a wearing procedure without contamination.

Other advantages, features and use modes of the present invention will result evident from the following detailed description of embodiments thereof, shown by way of example and not for limitative purposes.

BRIEF DESCRIPTION OF THE FIGURES

The figures of the enclosed drawings will be referred to, wherein.

DETAILED DESCRIPTION OF PREFERRED EMBODIMENTS

Figure 1B:
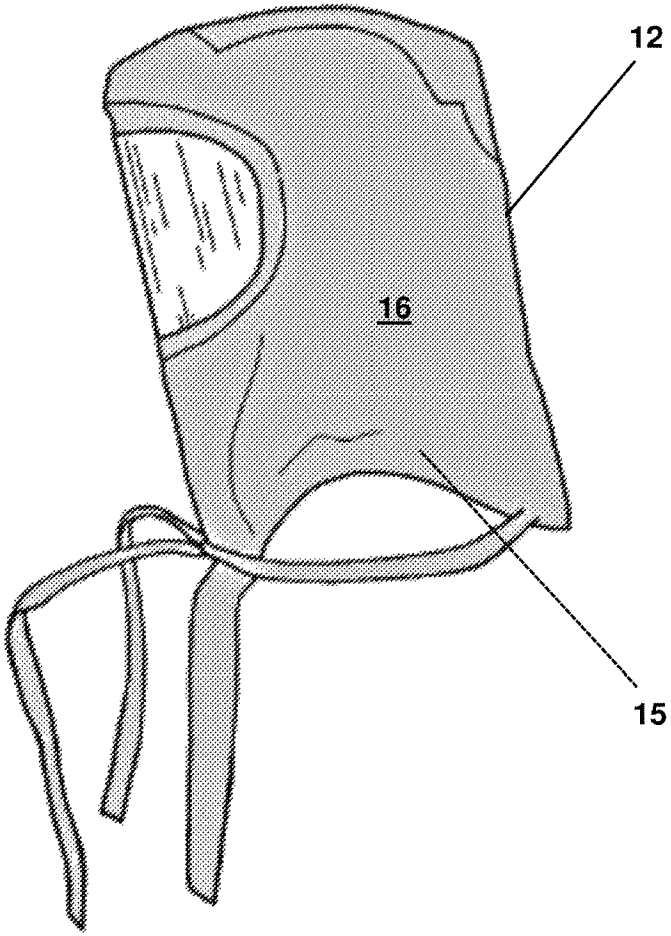
FIGS. 1A to 1B show a front view e a side view di a preferred embodiment of the hood according to the present invention, respectively.
Figure 1A:
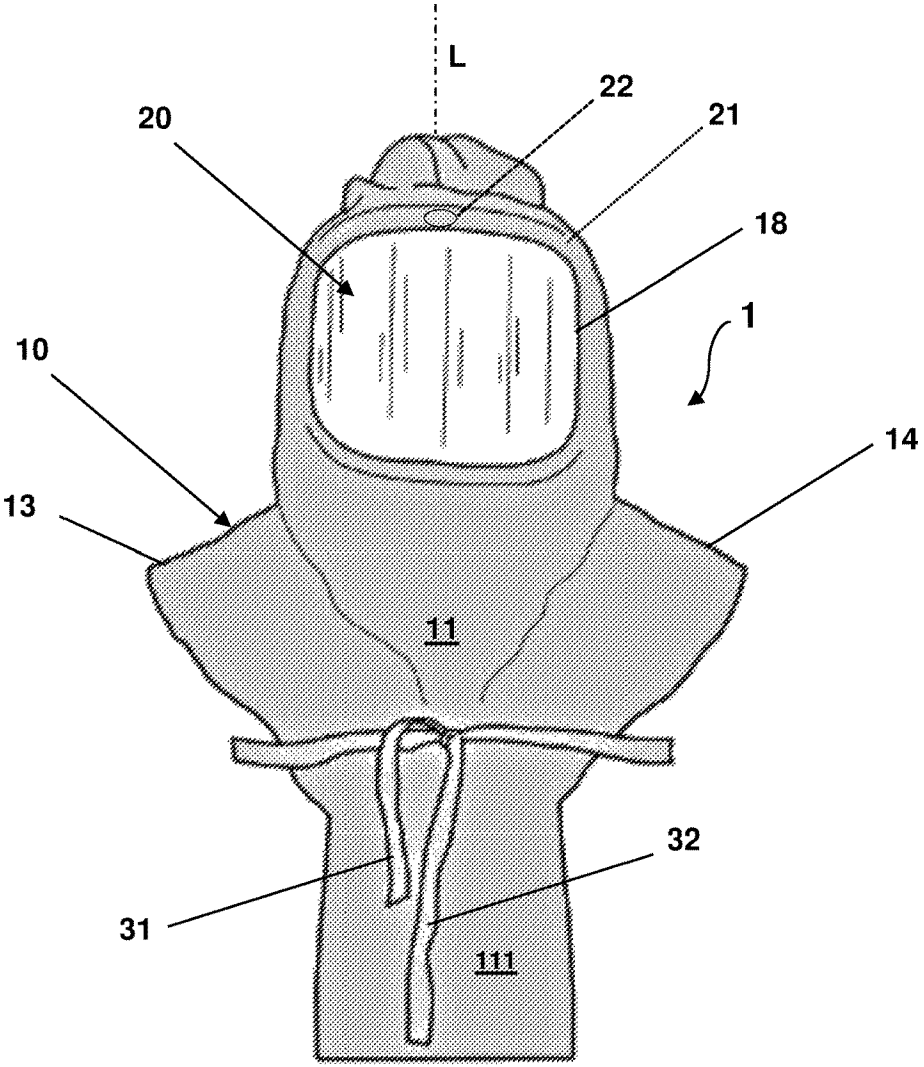

With reference to FIGS. 1A and 1B, a hood according to a preferred embodiment of the invention is designated as a whole with 1. The hood 1 is suitable to be worn by a surgeon during an operation in the operating room.

Applicative variants can provide a use in other contexts in which a, in particular sterile, garment or harness is required, for example a clean room of a laboratory.

The hood 1 is apt to be sterilized and provided folded in a packaging, sterile too, according to modes which will be described hereinafter.

In the present embodiment, the hood 1 is of disposable type.

Figure 2:
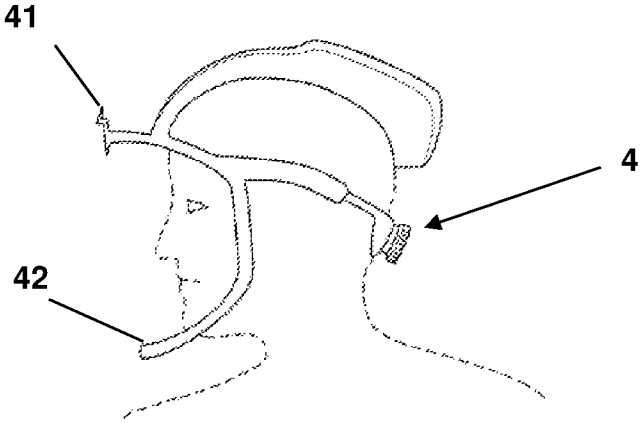
FIG. 2 shows a side view of the head, neck and part of the chest of an operator wearing a surgical helmet for use together with the hood of the invention.

The hood 1 is meant to be worn over an instrumented surgical helmet, the latter shown schematically in FIG. 2 and herein designated with 4.

The hood 1 is generally symmetrical with respect to its own longitudinal axis L which, in use, corresponds substantially to the sagittal plane of the operator wearing it.

On the hood 1 an internal face, or side, 15 and an external face, or side, 16, can be identified so defined since the first one, after wearing, is in direct contact with the subject's body, whereas the second one indeed is faced towards the external environment. The latter face is the one which has to remain sterile even after wearing, in order not to contaminate the operating environment.

The hood is configured to cover completely the operator's head, neck and an upper part of the chest of the operator wearing it and this by means of its own enveloping main body 10. The latter is made of flexible material and preferably made of fabric.

The main body 10 is fixed, at its own front opening 18, on a peripheral region 21 of a front vision lens 20. The latter, in use, positions at least at the operator's eyes, preferably extending on a wide portion of the subject's face so as to guarantee an adequate and comfortable field of view during the surgical operation.

The vision lens 20 has connection means, in particular hooking means 22 in form of through-hole, at a corresponding hook-like appendix 41 of the surgical helmet 4.

The main body 10 is advantageously implemented in one single piece. Thereupon a front portion 11 and a rear portion 12 connected and made integral by means of two opposite side portions 13 and 14 can be identified.

The front portion 11 has a lower appendage 111 shaped like a bib, which extends, in use, on the operator chest. Preferably, it has squared, that is polygonal, shape, whereas the remaining peripheral edges of the main body 10, in particular at the rear portion 12 and side portions 13, 14, have generally rounded or bent profile.

The bib-like appendage 111 determines a greater longitudinal extension for the front portion 11 with respect to the rear one 12.

Respective first longitudinal ends of a first and a second lateral string, respectively 31 and 32, arranged on opposite sides with respect to the longitudinal axis L, that is to the sagittal plane of the operator, are fixed on the rear portion 12 of the main body 10.

Advantageously, the strings 31 and 32 are fixed to the main body 10 at a lower periphery of the rear portion 12.

The side strings 31 and 32, in use, extend laterally outside of the rear portion 12 and are configured to be grasped by the operator during wearing of the hood 1 in order to unwind said rear portion 12 and bring it to cover the rear part of the head, the neck and the chest, as it will be described shortly.

The strings 31 *e* 32 are configured so as to allow a distance to be maintained between the arms of the subject and the main body of the hood during wearing sufficient to avoid contact between the outside of the main body of the hood 1 and the arms of the operator who performs the wearing operation autonomously.

Advantageously, the strings 31 and 32 also have a length so as to be enveloped at the end of the wearing-on of the hood 1, around the chest to be knotted to one another on the front portion 11 of the main body 10, for example on the bib-like portion 111 thereof.

In a preferred embodiment variant, the strings have each one a length comprised in a range of about 20-150 cm.

In an embodiment, the strings 31 and 32 are each one in the form of a web, having limited thickness with respect to their own longitudinal and transverse dimensions. They can have a substantially rectangular plan shape.

The strings 31 and 32 can be made of the same material of the main body 11, in particular of fabric, or even of different material, for example with elastic properties.

The modes for wearing the hood 1 will be now described with reference to FIGS. 3 to 6D.

Figure 3:
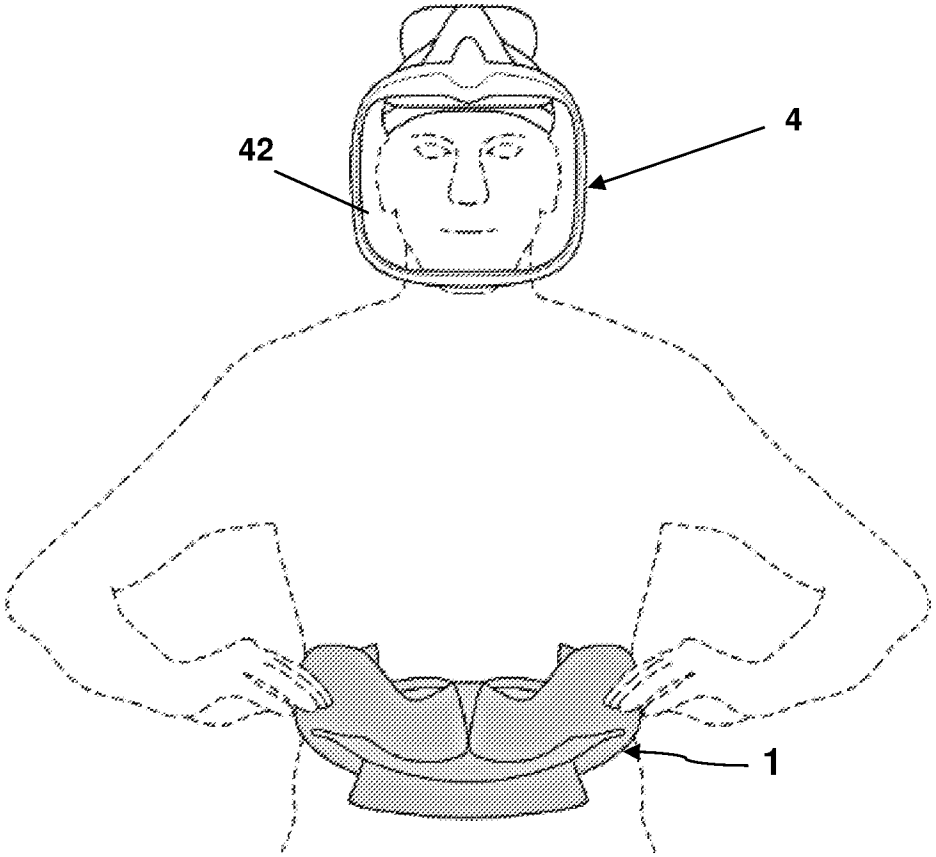
FIG. 3 shows a front view of the operator of FIG. 2 which is ready to wear the hood of FIGS. 1A and 1B, the latter provided in folded form, as just extracted from a packaging.

As shown in FIG. 3, the operator grasps the hood 1 in folded form, typically as received in a packaging, and under sterile conditions. Typically, the operator touches the hood 1 with sterile gloves (for sake of simplicity not represented in the figures). Generally, the face of the hood 1 exposed after folding is the internal one 15.

Figure 4B:
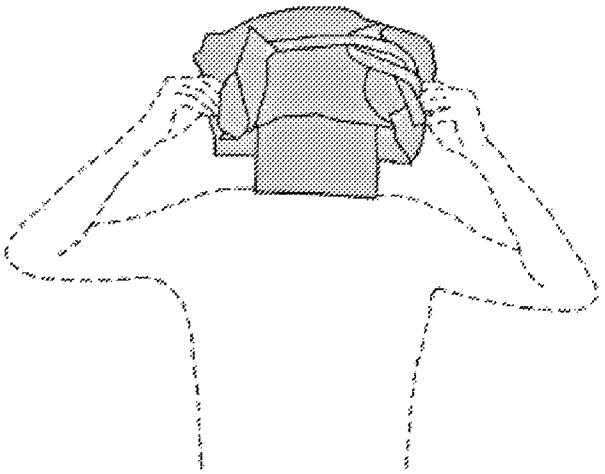
FIGS. 4A to 4G show each one a front view of an operator in a respective phase of wearing the hood of FIGS. 1A and 1B.
Figure 4D:
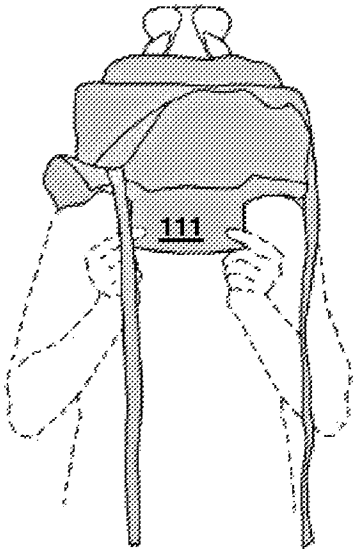
Figure 4A:
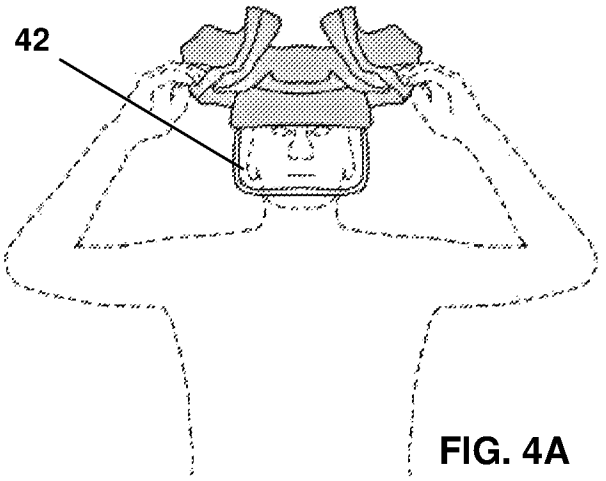
Figure 4C:
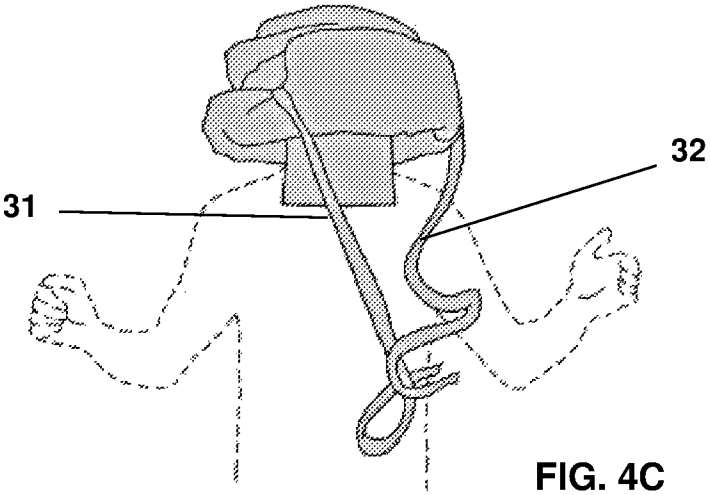

As shown schematically in FIG. 4A, the operator hooks the vision lens 20 to the hook-like appendix 41 of the helmet 4, in this way by connecting the whole hood 1 to the helmet itself.

As shown in FIG. 4B, the hood is then rotated downwards, still in folded form, so that the vision lens 20 covers a front opening 42 of the helmet having same shape and sizes.

At this point, as shown in FIG. 40, the operator can leave that the hood 1 starts spreading out, that is unfolding, by allowing the strings 31 and 32 to hang downwards.

Figure 4F:
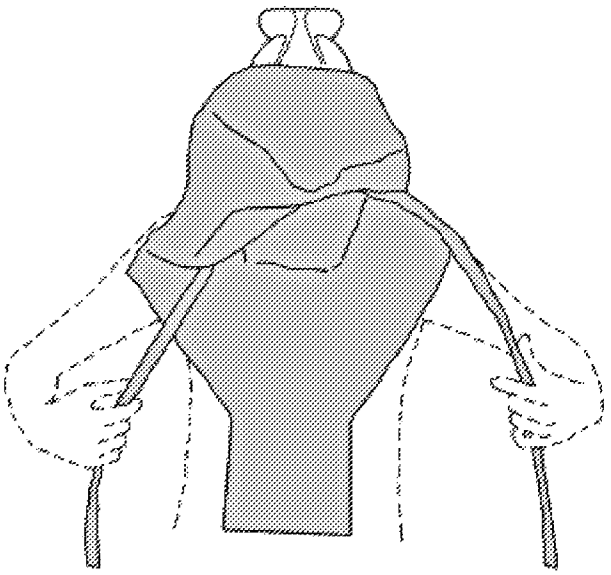
Figure 4E:
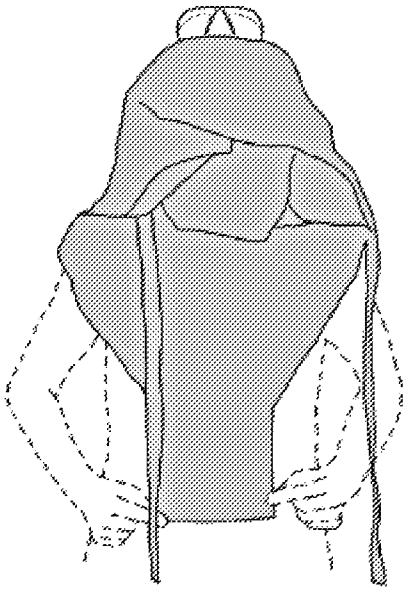

The operator, as shown in FIGS. 4D and 4E, can grasp the bib-like portion 111 and pull it downwards to cover the antero-superior part of the chest.

Figure 4G:
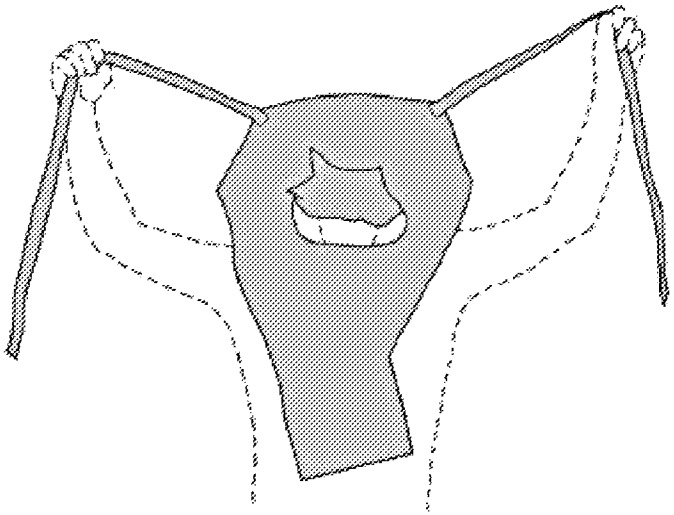
Figure 5A:
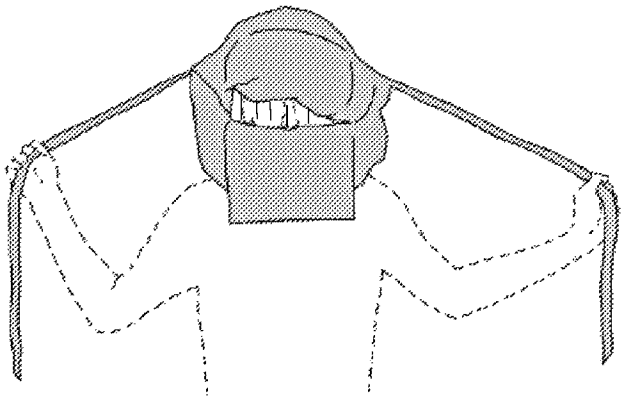
FIGS. 5A to 5E show each one a front view of an operator in a respective phase of wearing the hood of FIGS. 1A and 1B, according to a wearing mode partially alternative to that of the preceding FIGS. 4A to 4G.
Figure 5B:
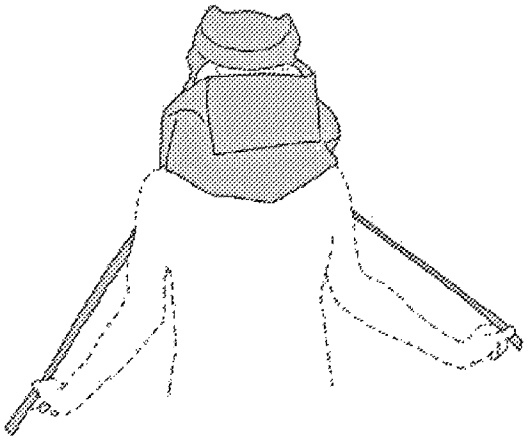
Figure 5C:
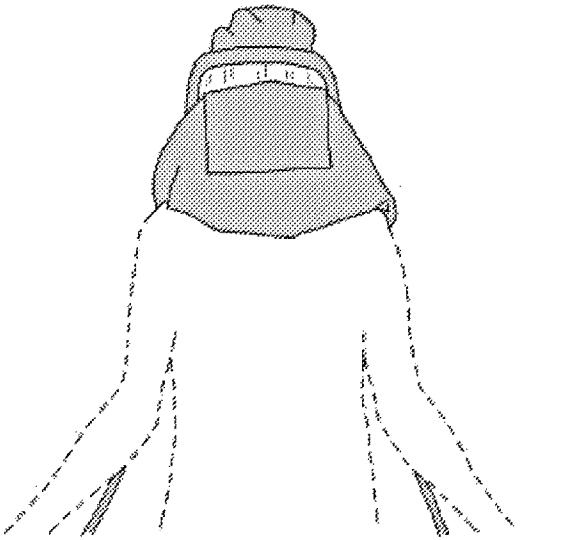
Figure 5D:
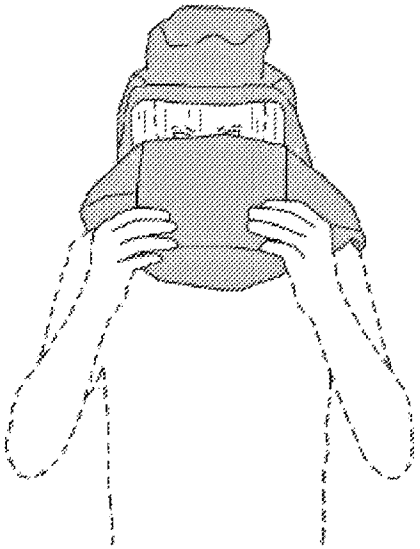
Figure 5E:
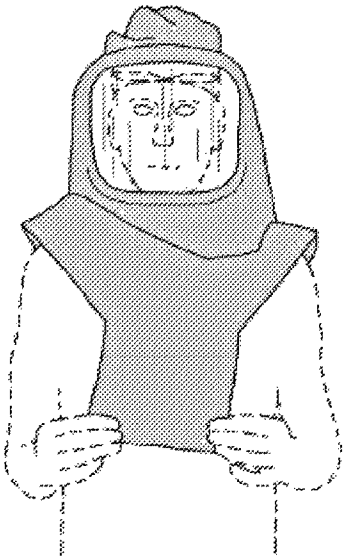
Figure 6B:
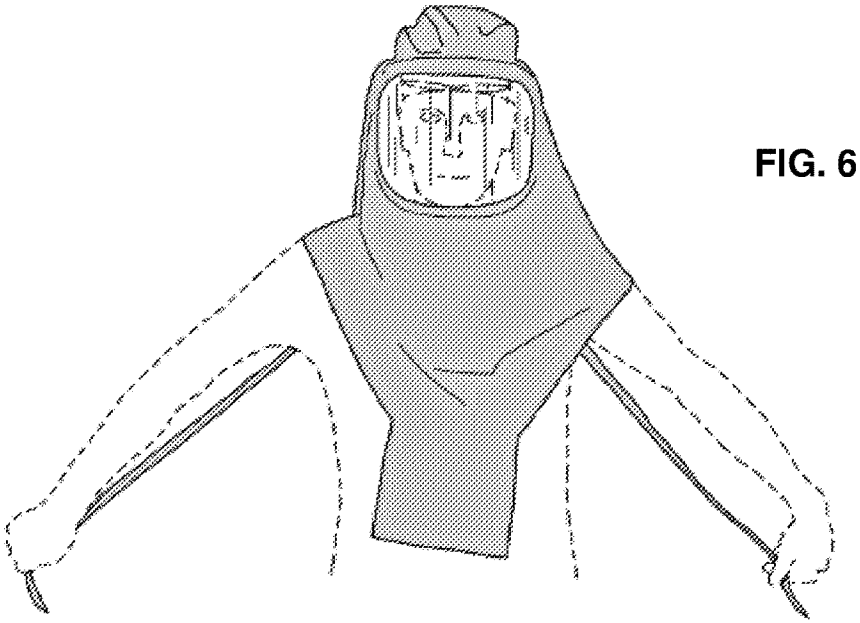
FIGS. 6A to 6D show each one a front view (or side view, for FIG. 6C) of an operator in a respective phase of wearing the hood of FIGS. 1A and 1B, with reference to the phases subsequent to those represented in FIG. 4A-4G or 5A-5E.
Figure 6D:
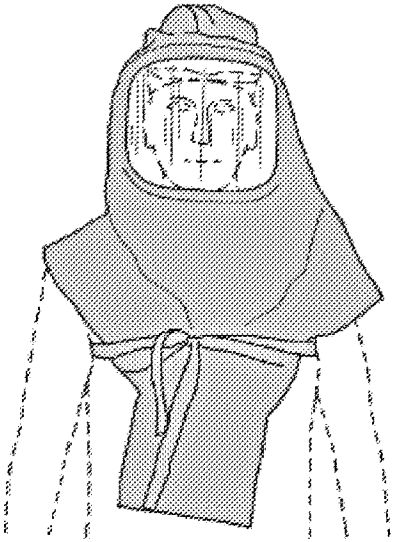
Figure 6A:
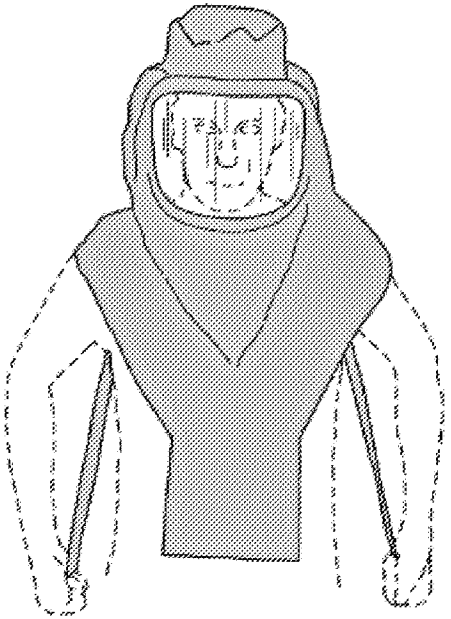
Figure 6C:
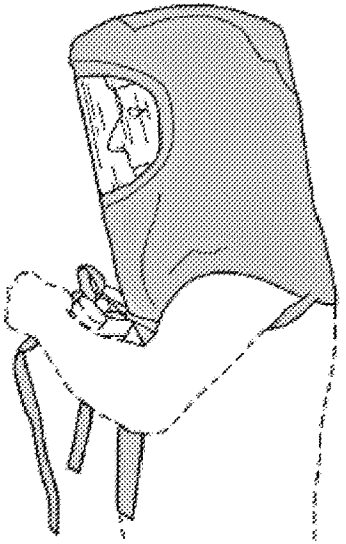

As shown in the sequence of FIGS. 4F and 4G, the operator then grasps the strings 31 and 32 and, with a simple motion of divarication and rotation backwards of the arms, it spreads out the rear portion 12 and the side portions 13 and 14 of the hood 1 too, to cover wholly the subject's body.

An alternative wearing mode, shown in the sequence of FIGS. 5A to 5E, provides that the operator spreads out at first the side 13, 14 and rear 12 portions and then the front one 11, 111.

Independently from which one of the two modes is adopted, the wearing can be completed with the sequence of phases shown in FIGS. 6A to 6D, wherein it can be seen that the operator grasps the strings 31 *e* 32 and it adduces them in posteroanterior direction until knotting them on the front portion 11 of the main body 10.

The harnessing of the operator then can conclude with wearing a sterile gown, which covers the lower portion of the hood, in particular the subject's shoulders and chest, then by re-closing the bib-like appendage 111 and the strings 31 and 32 at least in the portion knotted on the front side.

The hood of the invention can even be provided as a set, or kit, with a surgical helmet like the one mentioned above and/or with a gown, the latter wearable over a lower part of the main body of the hood itself.

The invention then provides even a method of wearing a hood which, with reference to the above-described embodiment, provides the following main steps of:

connecting the vision lens 20 on a surgical helmet 4 worn by an operator, in particular by hooking an opening 22 of said vision lens onto an appendix 41 of the surgical helmet 4;

grasping the strings 31, 32, divaricating them and exerting a traction in a rearward direction so as to unwind the rear portion 12 of the enveloping main body 10 on the head, neck and chest;

bringing the strings 31, 32 to wrap the chest in poster-oanterior direction and connecting, in particular knotting, the respective longitudinal ends at the front portion 11 of the hood 10 covering the chest.

The front portion 11 of the enveloping main body 10 can be pulled downwards before or after unwinding the rear portion 12.

As mentioned above, the hood 1 is preferably provided in folded form, advantageously sterile form, in a packaging which the surgeon or other operator opens at time of use (wearing).

The sequence of FIGS. 7A to 7F illustrates the different steps for folding the hood 1 during its packaging or however for the purpose of storage and/or transportation.

The hood 1 is meant laid down on a working plane with the lens 20 rested upon the latter. The hood at first is in unwound configuration, preferably overturned, that is with the inner face 15 faced outside.

Figure 7A:
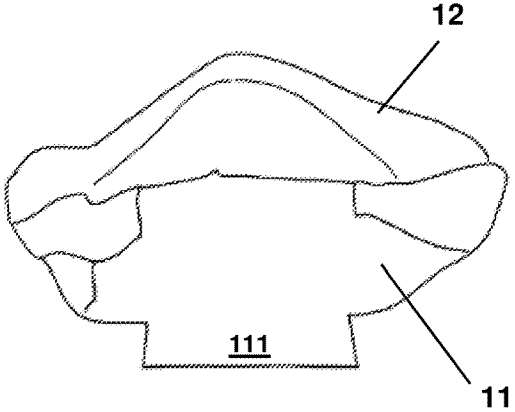
FIGS. 7A to 7E show each one a top plan view (or side view, for FIG. 7C) of a respective phase for folding the hood of FIGS. 1A and 1B for the purposes of its packaging.

First of all, as shown in FIG. 7A, the front portion 11 of the main body 10 is folded, with two or three folds, on the lens 20.

Figure 7B:
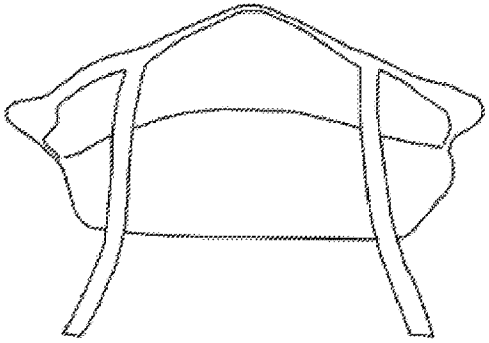
Figure 7C:
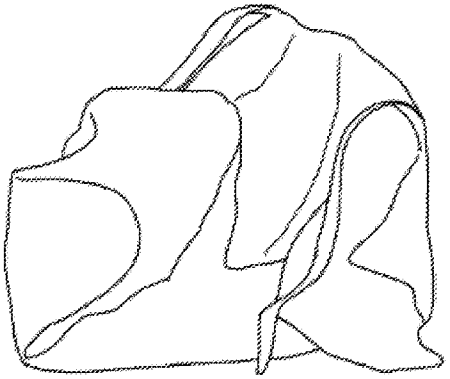

As shown in FIG. 7B, the rear portion 12 then receives five or six folds to be rested in such configuration on the already folded front portion 11. FIG. 7C too relates to such folding procedure of the rear portion 12, by showing a side view of the hood 1.

Figure 7D:
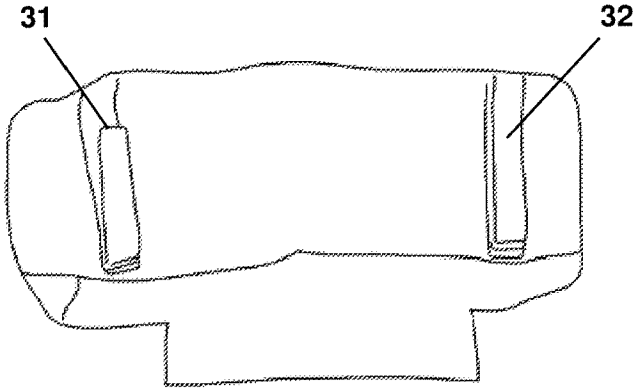

As shown in FIG. 7D, the strings 31 and 32 are then folded with multiple and regular folds and rested upon the already folded rear portion 12.

Figure 7E:
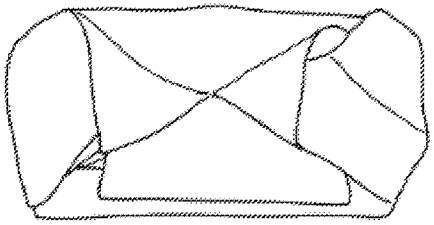
Figure 7F:
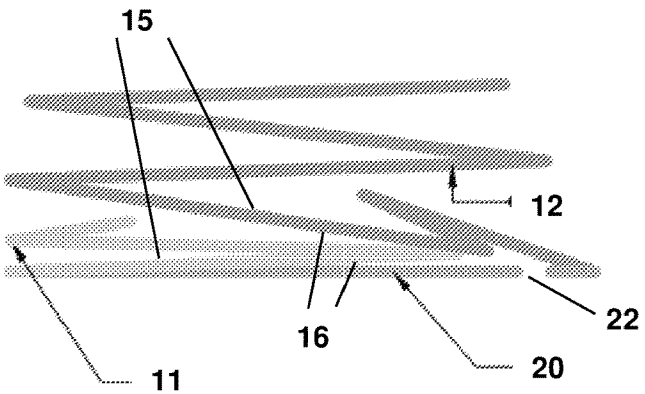
FIG. 7F shows a schematic side view of the hood of FIGS. 1A and 1B in the final folded configuration.

At last, as shown in FIG. 7E, the projecting external side margins and the bib-like appendage 111 are folded on the remaining portion of the hood 1, by allowing to obtain a compact configuration, and with minimum sizes, of the latter.

The present invention has been sofar described with reference to preferred embodiments thereof. It is to be meant that other embodiments belonging to the its inventive core may exist, as defined by the protective scope of the herebelow reported claims.

NUMBERING OF THE COMPONENTS IN THE FIGURES

1—Hood
L—Longitudinal axis of the hood
15—Inner face of the hood
16—Outer face of the hood
20—Vision lens of the hood
21—Peripheral region of the vision lens
22—Hooking means of the vision lens
10—Enveloping main body of the hood
11—Front portion of the enveloping main body
111—Bib-like appendage of the front portion
12—Rear portion of the enveloping main body
13, 14—Opposite side portions of the enveloping main body
18—Front opening of the enveloping main body
31, 32—Side strings of the hood
4—Surgical helmet
41—Hook-like appendix of the helmet
42—Front opening of the helmet

The invention claimed is:

1. A protective hood suitable to be worn, in sterile form, by an operator, in an operating room or in a clean room, over a surgical helmet, wherein said protective hood is supplied in folded form and includes:

a front vision lens, apt to be positioned at least at the operator's eyes, an enveloping main body, fixed to said front vision lens at a peripheral region thereof and configured to cover completely the operator's head, neck and upper chest, wherein said enveloping main body comprises a front portion and a rear portion connected and made integral by two opposite side portions, and a first lateral string and a second lateral string, each lateral string of the first lateral string and the second lateral string being fixed, at a respective terminal end, on said rear portion of said enveloping main body, said first lateral string and said second lateral string being arranged on opposite sides with respect to a longitudinal axis of said protective hood, wherein said first lateral string and said second lateral string are configured to be grasped by the operator during wearing of the hood in order to unwind said rear portion and bring said rear portion to cover a rear part of the operator's head, neck and chest, wherein said first lateral string and said second lateral string also have a length configured to be arranged, after said rear portion covers the rear part of the operator's head, neck, and chest, around the operator's chest and connected, to one another at the front portion of said enveloping main body.

2. The protective hood according to claim 1, wherein said front portion has a lower appendage shaped like a bib, which extends, in use, on the operator's chest.

3. The protective hood according to claim 1, wherein said enveloping main body is made of fabric.

4. The protective hood according to claim 1, wherein said each lateral string is attached at a lower end part of said rear portion.

5. The protective hood according to claim 1, wherein said each lateral string is in a form of a web.

6. The protective hood according to claim 5, wherein said each lateral string has a substantially rectangular plan conformation.

7. The protective hood according to claim 1, wherein said first lateral string and said second lateral string are configured so as to allow a distance to be maintained between the operator's arms and the enveloping main body, during wearing, sufficient to avoid contact between an outside of the enveloping main body itself and the operator's arms.

8. The protective hood according to claim 1, wherein said each lateral string has a length in a range of about 20-150 cm.

9. The protective hood according to claim 1, wherein said each lateral string is made of fabric.

10. The protective hood according to claim 1, wherein said protective hood is sterilized or supplied in a sterile form within a package.

11. The protective hood according to claim 1, wherein said protective hood is a disposable type.

12. The protective hood according to claim 1, wherein said front vision lens has connection means to the surgical helmet.

13. An assembly comprising a protective hood according to claim 1 and the surgical helmet connectable to said front vision lens, wherein said protective hood is suitable to be worn over said surgical helmet.

14. The assembly according to claim 13, wherein said protective hood is supplied in a form of a kit.

15. An assembly comprising a protective hood according to claim 1 and a gown wearable over a lower part of said enveloping main body.

16. A sterile package, that comprises a packaging and a sterile protective hood according to claim 1, wherein said protective hood is housed in said packaging in a folded form.

17. The sterile package according to claim 16, wherein said front portion is folded immediately above said front vision lens, said rear portion is folded immediately above said front portion, and said first lateral string and said second lateral string are folded over said rear portion.

18. A method of wearing a protective hood according to claim 1, comprising:

(a) connecting said front vision lens on the surgical helmet worn by an operator, by hooking an opening of said front vision lens onto an appendix of said surgical helmet;

(b) grasping said first lateral string and said second lateral string, divaricating them and exerting a traction in a rearward direction, so as to unwind the rear portion of said enveloping main body on the operator's head, neck, and chest;

(c) bringing said first lateral string and said second lateral string to wrap the operator's chest in a posteroanterior direction and connecting the respective longitudinal ends of said first lateral string and said second lateral string at the front portion of the enveloping main body.

* * * * *